US010835031B2

(12) United States Patent
Sudoh

(10) Patent No.: US 10,835,031 B2
(45) Date of Patent: Nov. 17, 2020

(54) LIFTING TABLE WITH HEIGHT ADJUSTMENT DEVICE

(71) Applicant: Fumio Sudoh, Mitaka (JP)

(72) Inventor: Fumio Sudoh, Mitaka (JP)

( * ) Notice: Subject to any disclaimer, the term of this patent is extended or adjusted under 35 U.S.C. 154(b) by 0 days.

(21) Appl. No.: 15/749,695

(22) PCT Filed: Aug. 2, 2016

(86) PCT No.: PCT/JP2016/072601
§ 371 (c)(1),
(2) Date: Feb. 1, 2018

(87) PCT Pub. No.: WO2017/022739
PCT Pub. Date: Feb. 9, 2017

(65) Prior Publication Data

US 2018/0213927 A1 Aug. 2, 2018

(30) Foreign Application Priority Data

Aug. 2, 2015 (JP) ..... 2015-153015

(51) Int. Cl.
*A47B 9/00* (2006.01)
*A47B 9/10* (2006.01)
(Continued)

(52) U.S. Cl.
CPC ..... *A47B 9/10* (2013.01); *A47B 9/20* (2013.01); *A47B 21/02* (2013.01); *A47B 91/06* (2013.01)

(58) Field of Classification Search
CPC .. A47B 9/10; A47B 9/20; A47B 21/02; A47B 91/06
See application file for complete search history.

(56) References Cited

U.S. PATENT DOCUMENTS 1,590,296 A * 6/1926 Klein ..... A47B 9/10 108/106
3,080,835 A * 3/1963 Guglielmi ..... A47B 9/10 108/116
(Continued)

FOREIGN PATENT DOCUMENTS

DE 101 25 995 A1 11/2002
JP 52-27043 Y1 6/1977
(Continued)

OTHER PUBLICATIONS

International Search Report for PCT/JP2016/072601 dated Sep. 20, 2016 [PCT/ISA/210].

*Primary Examiner* — Matthew W Ing
(74) *Attorney, Agent, or Firm* — Sughrue Mion, PLLC

(57) ABSTRACT

A lifting table includes a top plate height adjustment device that performs a height adjustment of all support columns in a synchronized manner. The top plate is supported on the floor by of a leg structure provided with multiple support columns arranged in parallel. Top plate receiving structures attach a column to the top plate and change the length of the support columns. Push valves exposed on the inside of the top plate receiving structures are actuated, changing the length of gas springs provided inside of the support columns. By extending an operation rod unit into the top plate receiving structures from a single handle of an operation lever via a connection fitting, the push valves are operated the same amount and at the same time in all of the columns with a single operation, so that it is possible to smoothly raise and lower the top plate.

8 Claims, 8 Drawing Sheets

(51) Int. Cl.

| | |
|---|---|
| ***A47B 91/06*** | (2006.01) |
| ***A47B 9/20*** | (2006.01) |
| ***A47B 21/02*** | (2006.01) |

(56) References Cited

U.S. PATENT DOCUMENTS

| | | | | |
|---|---|---|---|---|
| 6,116,690 | A * | 9/2000 | Larson | A47B 9/10 248/404 |
| 6,182,583 | B1 * | 2/2001 | Larson | A47B 9/10 108/147 |
| 7,028,957 | B1 * | 4/2006 | Larson | A47B 9/10 108/147 |
| 10,321,755 | B1 * | 6/2019 | Sie | A47B 9/06 |
| 2005/0150437 | A1 * | 7/2005 | Chen | A47B 9/10 108/147 |
| 2018/0271733 | A1 * | 9/2018 | Davis | A61G 13/06 |
| 2019/0174913 | A1 * | 6/2019 | Lin | A47B 9/20 |

FOREIGN PATENT DOCUMENTS

| | | | |
|---|---|---|---|
| JP | 57-22835 | Y2 | 5/1982 |
| JP | 10-262741 | A | 10/1998 |
| JP | 11-127964 | A | 5/1999 |
| JP | 3391285 | B2 | 3/2003 |

* cited by examiner

LIFTING TABLE WITH HEIGHT ADJUSTMENT DEVICE

CROSS REFERENCE TO RELATED APPLICATIONS

This application is a National Stage of International Application No. PCT/JP2016/072601 filed Aug. 2, 2016, claiming priority based on Japanese Patent Application No. 2015-153015 filed Aug. 2, 2015, the contents of all of which are incorporated herein by reference in their entirety.

FIELD OF TECHNOLOGY

This Invention relates to lifting tables comprising the top plate, multiple support columns for supporting said top plate, and height adjustment device for adjusting the height of said top plate from the floor by operating the length of said such columns.

BACKGROUND TECHNOLOGY

At present, on aspects of the devices with lifting function like office tables, shelving units or working platforms (hereinafter referred to as "lifting table"), a technical solution has been proposed which comprises a top plate on which the articles are placed and various operations are implemented, and one or several support columns supporting the aforesaid top plate, and is also equipped with height adjuster for the top plate with which the surface of the top plate could be adjusted to a reasonable height convenient for the user to place articles or to operate properly on the top plate.

For example, the single chair like office chair is equipped with single stilt having air spring (also known as "high pressure air cylinder") to lift the seat surface. On the other hand, there is a kind of table with single stilt supporting the top plate like the chair among the tables with small top plate for one person or for exhibiting small articles; a table-board lifting device with which the length of the stilt—the height of the top plate is changed or adjusted by operating the air spring in the stilt has been proposed (refer to Patent Literature 1). In such table-board lifting device, the stilt is composed of cylindrical external strut and internal strut loosely inserted, and is telescopic; the ends of the air spring are fixed on two struts respectively; two struts are led to the extending or shortening direction under the engagement effect between the raised line and the groove so that two struts could not rotate relatively. Thus, it could stop the top plate rotating around the stilt and meanwhile adjust the height of the top plate.

With regard to the tables with a considerable top plate area, the top plate generally is supported with two or more struts with air spring, disposed at least either the left side or the right side of the table (refer to Patent Literature 2). As disclosed in Patent Literature 2, the top plate height adjuster would not change the top plate height unlimitedly, but it is used to adjust the thrust arisen from the variation of the load applied on the top plate. The air springs are supported in rotatable condition at their lower ends, forming a special mechanism having bracing pieces, connecting rods and sticks etc. mounted between upper end of air spring and the table. The thrust is adjusted by changing the position of the upper end of the air spring on the strut. In this regard, the movement of the aforesaid mechanism would be linked with the mechanism on other struts through the shaft connector. The top plate height is adjusted by operating the air spring mounted at least on either side of the table with the pedal.

However, it has not been disclosed in Patent Literature 2 how to adjust two air springs synchronously when both struts are provided with air springs.

In the case of top plate height adjuster supported with two struts, there is a device which may be used to change or adjust the length of two struts at the same time by single operation (refer to Patent Literature 3). Such height adjuster is composed of as follows: The lifting struts, arranged vertically on both sides of the table top plate, are mounted in the stilts of the table, and may move up/down freely but could not move forward/backward; meanwhile, the aforesaid two lifting struts are linked together by the chains on several pulleys pivotally mounted on the fixing parts of the table; rocking plate is pivotally mounted on the fixed part of the table and is connected to the aforesaid chain; besides, screw shaft which faces up/down but could not move forward/backward is pivotally mounted on the foresaid rocking plate, and meanwhile, one end of the air spring is connected pivotally to the fixed part of the table while another end is connected on the metal adjusting part combined with the aforesaid screw shaft. In the top plate adjuster specified in Patent Literature 3, the thrust adjusting mechanism of lifting strut is mounted in the lifting link gears of the left and right stilts, and are connected to the aforesaid link gear; the aforesaid adjusting mechanism is adjusted along with the variation of the load applied on the top plate so as to adjust the thrust on the lifting strut; the top plate could be adjusted up and down easily, evenly and at low cost without the influence of the load on the top plate.

However, with regard to the lifting table with the top plate to be supported separately by several struts each of which provided with an air spring, it requires control items (elements) for height adjustment actions of individual air springs on the struts, namely the start/stop time for height adjustment action of individual struts and the amount of height adjustment operation, should be kept synchronous. If such operation items were not kept synchronous, the height adjustment actions for the air springs of individual strut would not be consistent; and the top plate would unavoidably be unable to move up and down synchronously and would tilt. Consequently, it would be difficult to operate the top plate height adjuster smoothly. In the worst case, the top plate would stay in tilting state and could not move. In the top plate adjuster specified in Patent Literature 3, it is necessary to install additional connection mechanism with complex structure for keeping the amount of operation for the left and the right stilts consistent, which would take much time for manufacture, assembling and adjustment, and increase the costs.

PREVIOUS TECHNICAL LITERATURE

Patent Literature

Patent literature 1: Patent Publication No. 3391285
Patent literature 2: Patent Laid Open Publication No. H11-127964
Patent literature 3: Patent Laid Open Publication No. H10-262741

SUMMARY OF INVENTION

Problems to be Solved with Invention

When buckling steel wire rod easy to work with to fabricate height adjustment operation lever (handle) as a whole for lifting up/putting down more than two air springs, it is very difficult to make all air springs act synchronously due to operating error; thus, the operation lever might be bent, twisted or otherwise deformed by reasons of its rigidity and strength. For avoiding such phenomenon, it could be considered for example to punch or bend wire rods with big diameter and high rigidity for fabricating them into one-piece processed goods which would be free from bending and other deformation etc. However, it is not easy to fabricate such operation lever; and it could not accommodate the error of leg structures and other mechanisms such as receiving structures supporting top plate and engaged with the struts. Therefore, it is still difficult to make all air springs act synchronously. Besides, the overall fabrication costs including material expenses and processing charges would increase.

Even though, the operation lever does not have problem itself, but it is very difficult to avoid unbalanced assembling error in supporting structure of the operation lever and the assembled structures of the air spring push valve (lifting button) and the operation lever for starting the air spring embedded in the strut. It would be extremely difficult to support the operation levers and assembling all air springs together under identical conditions. It would be more difficult to support the operation levers and assembling them together under same conditions, if the space between the air springs is wider.

In this case, it would be very difficult to make two air springs move up and down simultaneously with the same amount due to the aforesaid deformation as well as the fabrication error or assembling error, even if two air springs are started by operating the operation levers. Although it may be possible to eliminate the error by re-assembling, repairing manually or adjusting the components etc., but such treatment would leads to an increase in the number of working processes and cost. Therefore, the movements of several springs could not be synchronized and it would take much time to adjust the top plate height merely by extending the existing technology.

Thus, with respect to the lifting table supported by several struts with air springs, it is necessary to improve its adjustment operability so that the any air springs could be adjusted simultaneously of same adjusting amount to change the length of the strut. There is still pending problem on aspect of synchronous movement of air springs in individual strut, although the operation required for the user to adjust the top plate height is of single operation.

This Invention is to solve the aforesaid problem and provide a lifting table with top plate height adjustment device, which could realize synchronous height adjustment of individual struts through single operation and complete the height adjustment of top plate smoothly.

Method for Solving Problem

For solving the aforesaid problem, this Invention provides a lifting table provided with top plate height adjustment device, which comprises a top plate, and a leg structure with multiple support columns mutually arranged in parallel for supporting said top plate relative to the floor, characterized in that said each support column has a length-changeable gas spring installed therein and is attached to said top plate via the top plate receiving structure; said each gas spring has a push valve for changing the length itself exposed on the inside of said top plate receiving structure, said push valve operated by an operation lever to change the length of said support column, thus adjusting the height of said top plate from the floor; said operation lever comprises a single handle and the operation rod units that extend respectively and individually to said all top plate receiving structure from said single handle; said all operation rod units or all the remaining said operation rod units except for one operation rod unit include multiple rod sections which are connected by connectors respectively; said each rod section extending to the inside of said top plate receiving structure has gas spring operation portion on its tip end for operating said push valve.

With regard to the lifting table with top plate height adjustment device, the top plate is supported on the floor with a leg structure with multiple support columns mutually arranged in parallel. The average load on each column is reduced so that they could assume bigger load applied on the top plate. Each support column is mounted on the top plate with the top plate receiving structure and accommodates air spring whose lengths are variable. For changing the length of the support column, it is necessary to change the length of the air spring. For this purpose, it is necessary to operate the push valve of air spring with the operation lever. The operation lever comprises operation rod units which extend respectively and individually from a single handle into all the receiving structures, and all operation rod units or all but one operation rod unit include multiple rod sections which are connected by connectors, and each rod section extending to the inside of said top plate receiving structure has gas spring operation portion on its tip end for operating said push valve. It could realize the synchronous equivalent operations of push valve exposed in the receiving structure of the top plate by single operation of handle with the air spring operating portion, so that the movement of the air springs—height adjustment movement of individual support column could stay the same. Besides, one operation rod unit which do not include a connector is directly connected to the handle so that such operation rod unit would become the benchmark operation rod unit when other operation rod units are required to be synchronous.

In this lifting table with top plate height adjustment device, the following structure may be adopted, that is, said support columns for supporting said top plate consist of two support columns; two said operation rod units of said operation lever include respectively, as said multiple rods, the first rod sections that extend horizontally from said handle, and the second rod sections that extend along the direction perpendicular to said first rod sections to the inside of said top plate receiving structures and are provided said gas spring operation portions on tip ends thereof; said connectors are two L-shaped connectors, each connector connects said first rod section and said second rod section, so as to form two units each including said first rod section and said second rod section.

With regard to the lifting table with top plate height adjustment device, it is composed of: two first lateral rod sections which extend laterally from the handle, and the second rod sections each of which extends from L-shaped connector into top plate receiving structure and has an air spring operation portion on its tip end; the second rod section is connected to the first rod section via the L-shaped connector. The first rod section and the second rod section which are connected by the L-shaped connector not only maintain the orthogonal arrangement owing to the L-shaped connector, and may absorb the fabrication error or assembling error generated when assembling, and bending, twisting or other deformation arisen from individual rod section when two air springs move up and down. Consequently, the air spring operation portions on the tops of the second rod sections would contact with push valves of two air springs and realize synchronous operation of pushing actions so that the up/down operations could be completed smoothly.

In this lifting table with top plate height adjustment device, the following structure may be adopted, that is, said support columns for supporting said top plate consist of three support columns; said operation lever has two said operation rod units in order to operate said gas springs installed in the left and right support columns, each of said operation rod units includes, as said multiple rods, the first rod section that extends horizontally from said handle, and the second rod section that extends along the direction perpendicular to said first rod section to the inside of the top plate receiving structure and has said gas spring operation portion on its tip end; said connectors are two L-shaped connectors which connect said first rod sections and said second rod sections respectively, so as to form two units each including said first rod section and said second rod section; said operation lever has also another one rod unit in order to operate the third gas spring installed in said column located in the central position, said another one rod unit is the third rod section that extends to the inside of said top plate receiving structure from said handle and has the gas spring operating part on its tip end.

The lifting table with top plate height adjustment device comprises two first rod sections which extend laterally from the handle section, two second rod sections which are orthogonal from this position through L-shaped connectors, extend into top plate receiving structures and have air spring operation portions on tip ends, and the third rod unit which is related to the third air spring on the strut in the middle, and extends from the handle into the top plate receiving structure, and also has an air spring operation portion on its tip end. Therefore, three operation portions of rod sections may contact with air spring push valves respectively by single operation of the handle and realize synchronous operation of pushing actions.

In this lifting table with top plate height adjustment device, the following structure may be adopted, that is, all said second rod sections or all said second rod sections and the third rod section have lever fulcrums supported by said top plate receiving structures, each said gas spring operating portion pushes the push valve to work by the swing motion of said rod section while being supported at said lever fulcrum.

Besides, in this lifting table with top plate height adjustment device, the following structure may be adopted, that is, all said second rod sections or all said second rod sections and the third rod section are possible to move forward and backward in said top plate receiving structures and have tapered surfaces on tip ends engageable with said push valves as the gas spring operation portions, when said rod sections entering in said top plate receiving structures, said tapered surfaces being forced to engage with and to push said push valves to work.

In the top plate receiving structures, which receive the top plate and transfer the load on the top plate to the support columns; when it is so designed that all the second rod sections or all the second rod sections and the third rod section are supported on the lever fulcrums, it may be operated by one operation of the handle so that those second rod sections and the third rod section could start the levers at the lever fulcrums and consequently the air spring operation portions at the tip ends would contact with the push valves and push it to work.

Besides, when all second rod sections or all second rod sections and the third rod section could move in the top plate receiving structure and the gas spring operation portions on the tip ends are formed with tapered surfaces which could be engaged with the push valves, those second rod sections and the third rod section could enter the top plate receiving structure by single operation of the handle so that the tapered surfaces will get engaged with the push valves and push them to work.

In this lifting table with top plate height adjustment device, the following structure may be adopted, that is, said rod sections are fixed to said connectors in the condition that all gas spring operation portions contact to said push valves when said rod sections are in connection state by the connectors but not fixed yet. When the rod sections are engaged with the connectors but have not been fixed yet, the handle is operated to make all the air spring operation portions contact with corresponding push valves, and then fix them on the connectors so that the fabrication error and the assembling error or the bending, twisting and other deformation etc. could be absorbed fully; after that, when the handle section is operated, all air spring operation portions contact with corresponding push valves, and push corresponding push valves to realize synchronous operations of all air springs finally.

In this lifting table with top plate height adjustment device, the following structure may be adopted, that is, said top plate is a rectangle top plate that is longer in lateral direction, and two top plate receiving structures are set on the two sides apart in the lateral length direction of said top plate; with respect to said operation lever, said handle is set in the central position of the lateral long side edge of said top plate, said first rod sections extend along the lateral long side edge of said top plate, and said second rod sections extend in the direction perpendicular to said lateral long side edge via said L-shaped connectors.

The surface of the top plate on this lifting table is rectangle with long side on lateral direction, which is the most common. Two top plate receiving structures are set separately on two sides of the lateral length direction of the top plate, and could support the top plate and the articles on it stably to the floor.

In this lifting table with top plate height adjustment device, the following structure may be adopted, that is, said top plate is a rectangle top plate that is longer in lateral direction, and two top plate receiving structures are set close to one side in the lateral length direction of said top plate and are set apart in the longitudinal direction; with respect to said operation lever, said handle is set in the central position of the longitudinal short side edge of said top plate, said first rod sections extend along the longitudinal short side edge of said top plate, and said second rod sections extend in the direction perpendicular to said longitudinal short side edge via said L-shaped connectors.

The surface of the top plate on this lifting table is rectangle with long side on lateral direction, which is the most common. However, two top plate receiving structures are set close to one side of the lateral length direction of the top plate and are set apart in the longitudinal direction. Thus, the lifting table is suitable for the situations in which the article is tending to be placed to one side of the top plate (toward the direction with top plate receiving structure) or that the space below the top plate is to be used effectively.

In this lifting table with top plate height adjustment device, the following structure may be adopted, that is, said top plate is a L-shaped top plate with a curved inner edge, and two top plate receiving structures are set separately in a slant way with said curved edge of said top plate interposed between said receiving structures; with respect to said operation lever, said handle is set along said curved edge of said top plate, said first rod sections extend along the tangential direction of said curved edge, and said second rod sections extend in the direction perpendicular to said lateral rod sections via said L-shaped connectors.

This lifting table is very suitable as an office table or a working platform for the situations in which the L-shaped top plate is arranged, for example, by using the right-angle corner of the room, and the chair is arranged along the inside fan-arc edge for the user to work using the top plate of the lifting table.

In this lifting table with top plate height adjustment device, the following structure may be adopted, that is, said top plate is a fan-shaped top plate, two top plate receiving structures are set separately along the chord direction of the arc edge of said top plate; with respect to said operation lever, said handle is set along said arc edge of said top plate, said first rod sections extend along the chord direction of said arc edge, and said second rod sections extend in the direction perpendicular to said lateral rod sections via said L-shaped connectors.

This lifting table is very suitable as a working platform for the situations in which the fan-shaped top plate is arranged, for example, by using the right-angle corner of the room, and the chair is arranged along the arc edge for the user to work using the top plate of the lifting table.

In this lifting table with top plate height adjustment device, the following structure may be adopted, that is, said top plate is a rectangle top plate that is longer in lateral direction, two of said three top plate receiving structures are set close to one lateral long side of said top plate and are arranged in the longitudinal direction respectively, remaining one top plate receiving structure is set so as to form an isosceles triangle with said two top plate receiving structures; with respect to said operation lever, said third rod section extends directly from said handle and intersects in the direction perpendicular to said lateral long side edge. This lifting table is large in top plate area and could assume heavy weight. Thus, it is very suitable to be used as large table.

Effect of Invention

The structure of the lifting tables with top plate height adjustment device concerned in this Invention is as shown above. Thus, it has the following special effects. The top plate is supported with the table leg structure composed of several support columns arranged side by side so that the average load on each support column will be reduced and heavy load applied on the top plate could be support. Each support column is attached on the top plate through a top plate receiving structure which accommodates an air spring whose length is variable. For changing the length of the support column, it is necessary to change the length of the air spring by operating the push valve of the air spring with the operation lever. This operation lever comprises operation rod units which extend separately from single handle into all top plate receiving structures; all operation rod units or all but one operation rod units includes several rod sections which are connected via individual connectors. The tip end of rod section extended into the top plate bearing mechanism is formed with air spring operation portion which makes the push valve work so that the push valve exposed form the top plate receiving structure could be operated with the air spring operation portion by single operation of the handle, the push valve could be operated of equal amount and the actions of the air springs—the height adjustment actions of the support columns could stay the same. Therefore, the adjustment operability of equal amount for the column length at the same time is improved. The height adjustment actions for the lifting table with top plate supported by several support columns could be completed smoothly by a single operation.

The rod sections are connected via L-shaped connectors. With regard to the rod sections connected by the connectors, it not only could maintain the perpendicularity of the L-shaped connectors but also could fix the rod sections to the connectors by virtue of some allowance between the rod sections and connectors before fixing under the premise that all air spring operating sections contact with corresponding push valves. Therefore, the operation lever could be assembled in the state that the fabrication error and assembling error, or the bending or twisting deformation have been absorbed. Consequently, the actions pushing the push valves will become synchronized after the air spring operation portions on the tip ends contact with the push valves of air springs so that the support columns could extend-retract smoothly—i.e. the table could ascend/descend.

DETAILED DESCRIPTION

Figure 1B:
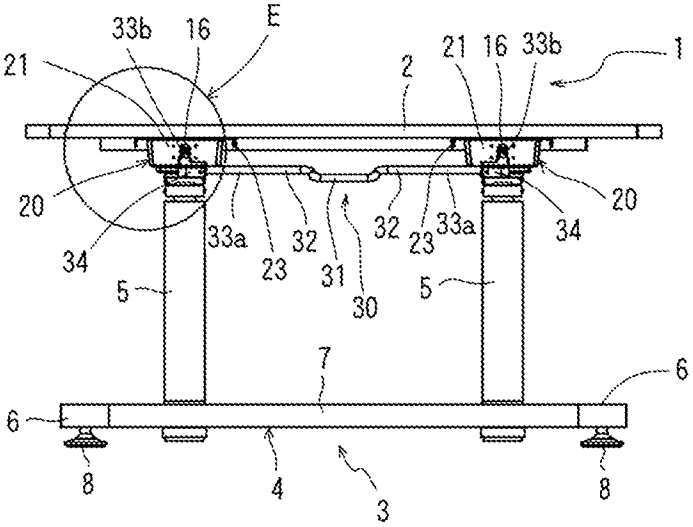
FIGS. 1A, 1B, 1C, 1D and 1E are views of the first embodiment of a lifting table provided with a height adjustment device according to the present invention.
Figure 1D:
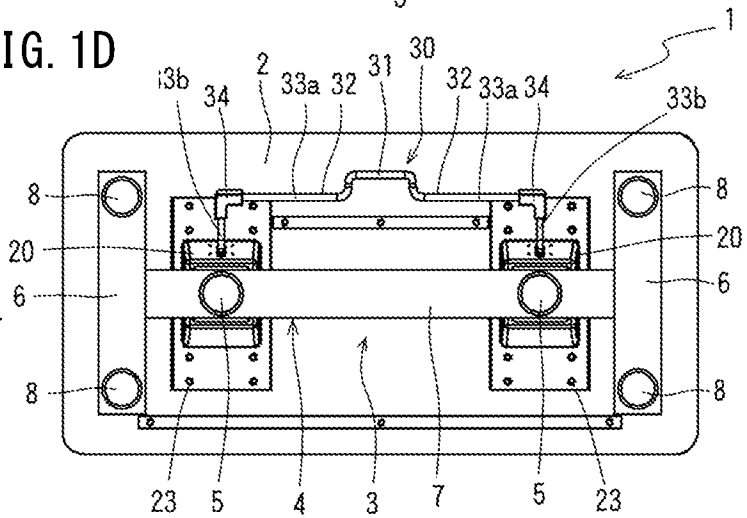
Figure 1A:
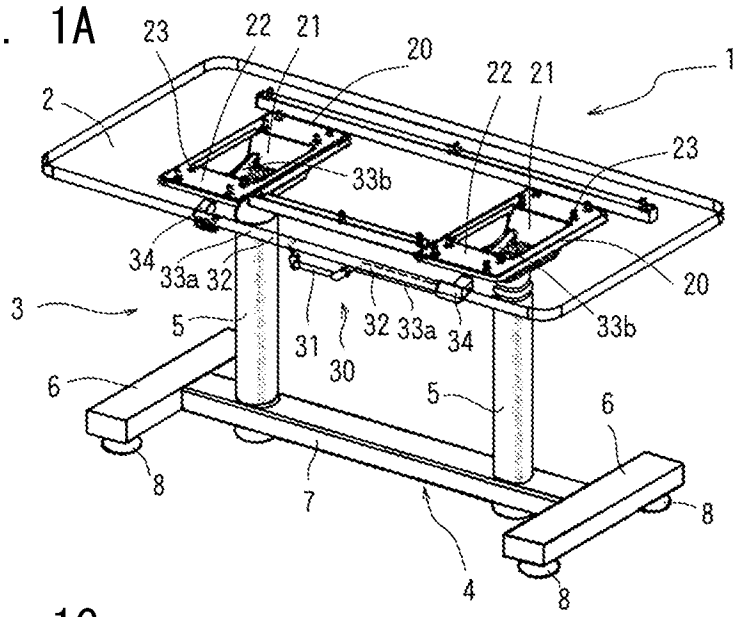
Figure 1E:
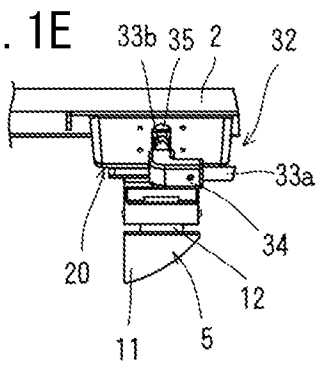
Figure 1C:
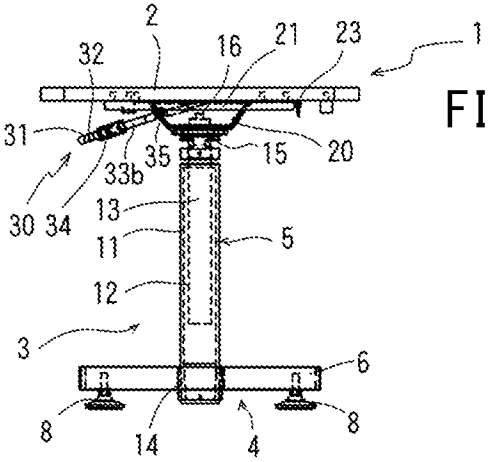
Figure 2A:
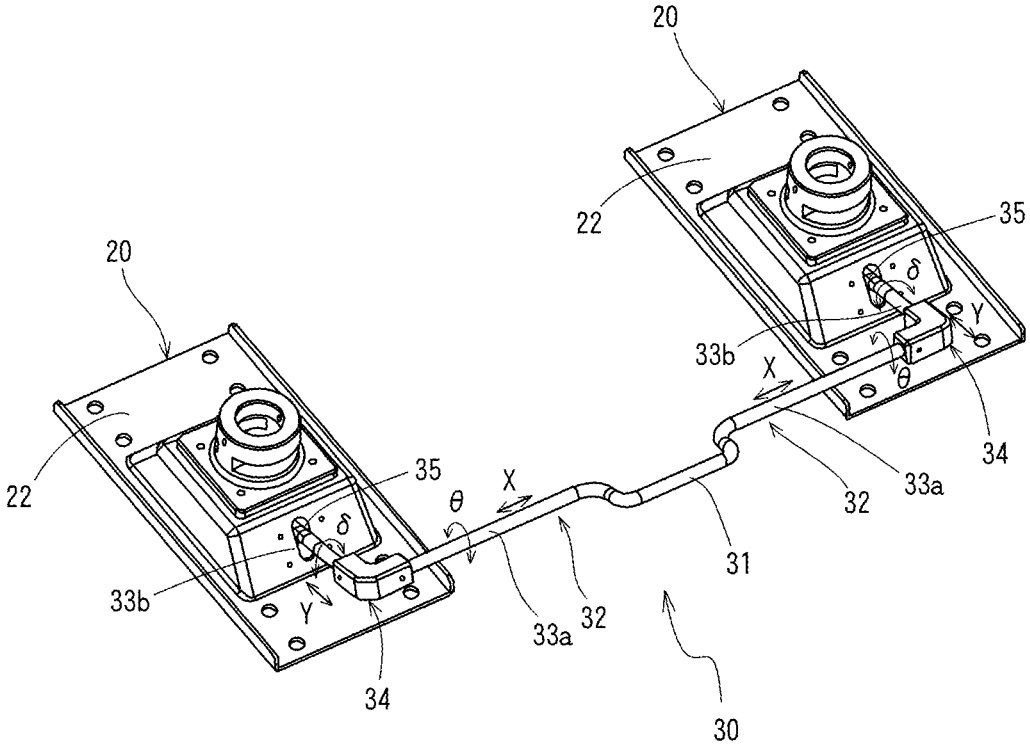
FIGS. 2A and 2B are detail views of an operation lever of the height adjustment device mounted on the lifting table shown in FIG. 1.
Figure 2B:
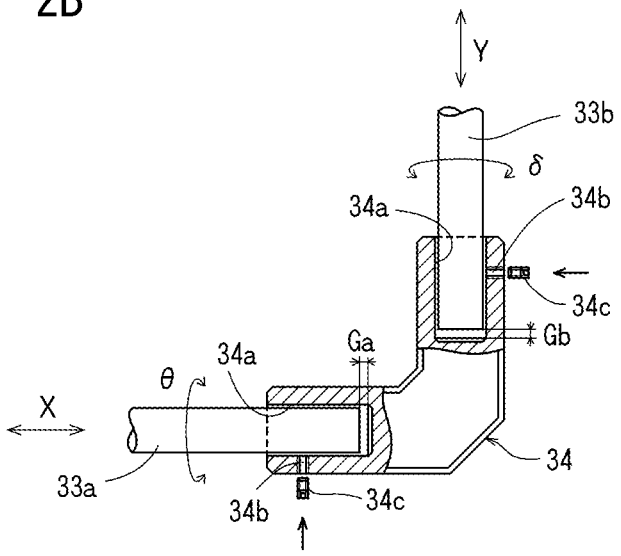

Referring now to the embodiments of the invention shown in the attached drawings, FIGS. 1A-1E show the first embodiment of a lifting table with height adjustment device according to the present invention, and FIGS. 2A and 2B the details of the operation lever of the height adjustment device mounted on the lifting table shown in FIGS. 1A-1E.

The first embodiment of a lifting table with the height adjustment device (hereinafter referred to as "lifting table") is shown in FIGS. 1A-1E; FIG. 1A is a perspective view of the lifting table, FIG. 1B is a front view of the lifting table, FIG. 1C is a side view of the lifting table, FIG. 1D is a top view of the lifting table and FIG. 1E is an enlarged view of the part encircled with circle E in FIG. 1B. The lifting table 1 comprises the top plate 2 and the table leg structure 3 supporting the top plate 2. The top plate 2 in the first embodiment is made of transparent glass, those in other embodiments are same, so that the table leg structure 3 can be seen through the top plate 2. The top plate 2 may be made of wood, resin, metal or other materials, and of course may be made of nontransparent materials.

The top plate 2 in the first embodiment is of rectangle plate which is the most common in office table or working platform. The table leg structure 3 comprises a H-shaped base leg body 4, and two support columns 5, 5 which are placed on the base leg body 4 for supporting the top plate 2. The base leg body 4 includes side leg portions 6, 6 placed in the long side direction of top plate 2 and a central leg portion 7 which connects two side leg portions 6, 6 together in central part. Supporting feet 8, 8 are mounted on the lower surfaces of the front and rear ends of each side leg portion 6. In the lifting table 1, the top plate 2 is stably supported on the floor with four support feet 8 which are set on the floor of same or smaller area than that of top plate 2 through the support columns 5, 5 and the H-shaped base leg body 4. It is also allowed to install small casters with locking function on the support feet 8 so that the lifting table 1 could move on the floor.

Each support column 5 comprises inner and outer cylinders which are telescopically engaged each other (outer cylinder 11 and inner cylinder 12 as air spring shield), a gas spring 13 is provided inside the inner cylinder 12. The outer cylinder 11 and the inner cylinder 12 may slide relatively along the longitudinal direction (the vertical direction in case of set up type) by means of sliding mechanism with longitudinal concave grooves and convex lines which is provided on a cap or a shield of upper end of outer cylinder 11. Although it is not indicated on the drawing, the lower end of the inner cylinder 12 may slide by virtue of the slider along the inner circumference surface of the outer cylinder 11. The lower end 14 of the outer cylinder 11 is supported by the central leg 7 of the base leg body 4. Receiving structure 20 (to be specified hereinafter) for supporting the top plate 2 is provided between lower surface of top plate 2 and upper end of each support column 5. The upper end 15 of inner cylinder 12 and the receiving structure 20 are made of iron or resin product like polypropylene reinforced with glass fibers, and may be fabricated in integrated form, or be assembled with parts which are fabricated separately and fixing parts like blind rivets.

The air spring 13 provided inside the support column 5, which is not shown in the drawing, may be the one well known that is composed of a cylinder and the piston rod which moves in the cylinder. With regard to the air spring 13, the lower base end of the cylinder is fixed on the lower end 14 of outer cylinder 11, and the upper end of the piston rod is fixed on the upper end 15 of inner cylinder 12. The top plate 2 is supported by the receiving structures 20 directly so that the load applied on the top plate 2 would be transferred to the columns 5 through the receiving structures 20. Namely, with respect to each receiving structure 20, the load would be transferred from inner cylinder 12, and via air spring 13, outer cylinder 11, base leg body 4 and supporting feet 8, 8 to the floor. Two support columns 5, 5, including the air spring 13 and the receiving structure 20, have the same structure.

For operating the air spring 13, the top end of the piston rod is fitted with one push valve 16 in the manner that it protrudes upwards from the piston rod. The push valve 16 is pushed with the operation lever 30 to control the flow of the gas in the air spring 13 so that the piston rod could move in and out of the air cylinder. With such function of the air spring 13, the inner and outer cylinders 11 and 12 could extend-retract to adjust the length of the columns 5, 5, namely the height of the top plate 2. The air pressure (5 kg, 8 kg, 10 kg or 20 kg) in the air spring 13 may be adjusted according to the weight applied on the top plate 2 of the table 1.

The receiving structures 20 is composed of a central recess section 21 of a structure of substantially square dish-shape as a whole and formed in a manner surrounded by disc-form side walls and a bottom wall, and peripheral section 22 which is continuous with the recess section 21 and has a flat upper surface formed in a manner surrounding to the recess 21. The receiving structure 20 may be formed by integrating the recess 21 and peripheral section 22, or assembled with the parts which are fabricated separately and the fasteners like blind rivets etc. The receiving structure 20 is fixed on the back of the top plate 2 on appropriate position of the peripheral section 22 with appropriate fasteners 23 (only some parts are numbered) like blind rivet. The receiving structure 20 can be fixed on the top plate 2 by disposing the receiving structure 20 closely on the back of the top plate 2 and pressing the blind rivet through the peripheral section 22 into the back of the top plate 2 without protruding from the surface of the top plate 2.

With respect to the gas spring 13 of the support column 5, the upper end 15 of inner cylinder 12 is connected to the receiving structure 20 in a manner running through the bottom wall of the recess 21 of the receiving structure 20. The push valve 16 of the air spring 13 penetrates through the upper end 15 of the inner cylinder 12 and is exposed in the inner space of the recess 21 of the receiving structure 20, and is disposed so as to be pushed down by the air spring operating part of the operation lever 30. The air spring 13 and the receiving structure 20 also could be combined with blind rivets.

In order to operate two air springs 13, 13 in the support columns 5,5 with one operation lever, this invention utilizes an operation lever 30 of a special structure. The operation lever comprises a single handle 31 having a shape protruding toward front side so as to be convenient for the user to hold, and operation rod units 32 which extend from the handle section 31 toward all top plate receiving structures 20 individually so as to operate the air springs 13 respectively. The operation rod unit 32 includes the first rod sections 33*a*, 33*a* which extend linearly along the left and right lateral directions on both sides of the handle section 31, L-shaped connectors 34, 34, as the connectors, mounted on the top ends of the first rod sections 33*a*, 33*a* and the second rod sections 33*b*, 33*b* which extend linearly from the connectors 34, 34 in the longitudinal direction (namely in the direction orthogonal to the first rod sections 33*a*, 33*a*) into the top plate receiving structure 20. The first rod sections 33*a*, 33*a* and the seconds rod sections 33*b*, 33*b* form multiple rod sections (all of which are numbered generally as "33") which are connected with the connectors 34, 34. The height adjustment device in the lifting table 1 includes the air springs 13, 13 which are provided inside the support columns 5, 5 and are connected to the top plate receiving structure 20,20, and the operation lever 30 which is used to operate the push valves 16, 16 of the air springs 13, 13. Each operation rod unit 32 is supported to the receiving structure 20 so as to swing with the lever fulcrum portion 35 of the second rod section 33*b* as a fulcrum.

FIG. 2 shows the details of the operation lever for height adjustment device provided with the lifting table. FIG. 2A is the perspective view of the operation lever and the receiving structure as a whole, and FIG. 2B is the partially sectional view showing the details of the L-shaped connector. As shown in FIG. 2A (also in FIG. 1B and FIG. 1C), the structure of the operation lever 30 is to ensure the axes of the handle 31 and operation rod unit 32 including the first rod sections 33*a*, 33*a*, the connectors 34, 34 and the second rod sections 33*b*, 33*b* to be on same plane. The structure of the operation lever 30 is to ensure the axes to be on same plane so that it could reduce the structure error and the occurrence of looseness and increase the operation accuracy of the operation lever 30. Each second rod section 33*b* runs through the side wall of the receiving structure 20 and extends into the recess 21, and the tip end portion of each second rod section 33*b* in the recess 21 becomes the air spring operating portion 36 which is machined into flat form. The second rod section 33*b* could tilt up and down relatively to the receiving structure 20 at the lever fulcrum portion 35 in the middle of the length. When the handle 31 is held, and the operation lever 30 is swung toward the direction of the top plate 2, the air spring operating portions 36, 36 would contact with and push down the push valves 16, 16 of the air springs 13, 13 at the same time so that two air springs 13, 13 would be started.

As shown in FIG. 2B, in the first rod section 33*a* and the second rod section 33*b* is formed holes 34*a*, 34*a* into which two end portions of L-shaped connector 34 may be inserted. The inner diameter of the holes 34*a*, 34*a* is sufficient for the first rod section 33*a* and the second rod section 33*b* to be inserted; sufficient gaps Ga, Gb for adjustment are reserved between the end faces of the first rod section 33*a* and the second rod section 33*b* and hole bottoms. There are opening-type screw holes 34*b*, 34*b* crossing with the holes 34*a*, 34*a* on the connector 34. The small screws 34*c*, 34*c* are screwed into the screw holes 34*b*, 34*b* so that the top ends of the small screws 34*c*, 34*c* could contact with the first rod section 33*a* and the second rod section 33*b* inserted in holes 34*a*, 34*a*, and the first rod section 33*a* and the second rod section 33*b* could be fixed on the connector 34 as per this position and attitude. For ensuring the rigidity and strength without substantial deformation under the effect of general operating force, and preventing the thread grooves of screw holes 34*b*, 34*b* from being scratched easily, the connector should be made of metals or resin products like nylon or (glass fiber reinforced) polypropylene etc. (integrated forming).

In the process of fabricating the operation lever 30, would occur machining errors that handle 31 and the first rod sections 33*a*, 33*a* and the second rod sections 33*b*, 33*b* are not on the correct positions in the same plane, or the first rod sections 33*a*, 33*a* are not arranged in same straight line, or the second rod sections 33*b*, 33*b* are not parallel. In such cases, it would be very difficult to synchronize the actions of push valves 16, 16 of air springs 13, 13 merely by operating the handle section 31—i.e. it would be relatively difficult to operate at the same time and in the same amount. Besides, when fabricating the first rod sections 33*a*, 33*a* and the second rod sections 33*b*, 33*b* only with rod material rather than connectors 34, 34, it would be very difficult to ensure that the first and the second rod sections 33*a*,33*b* in one unit are in the same plane to those of in another unit. When operating the operation lever 30, it would produce big deformation like bending or twisting etc. on the bending part from the first rod section 33*a* to the second rod section 33*b*, the operation of the handle 31 of the operation lever 30 could not be transferred to the second rod sections 33*b*, 33*b*, and the push valves 16, 16 of two air springs 13, 13 could not work synchronously. In such case, it would be unable to finish the height adjustment of the top plate 2.

The connector 34 used in this height adjustment device is allowed to rotate relatively around two axes to the first rod section 33*a* and the second rod section 33*b* before fixing state (rotate by θ around the axis of the first rod section 33*a* and by δ around the axis of the second rod section). Besides, in same state before fixing, it may move along the axis direction X of the first rod section 33*a* and the axis direction Y of the second rod section within the allowable scope of the gaps Ga and Gb. For realizing such rotational motion and movement, the handle section 31 of the function lever 30 is operated after loosening the small screws 34*c*, 34*c*, and the insertion amount and angle of the first rod sections 33*a*, 33*a* and the second rod sections 33*b*, 33*b* corresponding to the connectors 34, 34 are adjusted so as to make the air spring operating portions 36, 36 on the tip ends of the second rod sections 33*b*, 33*b* contact with the push valves 16, 16 of the air springs 13, 13 (only contact, without inward pushing), and tighten the small screws 34*c*, 34*c* in this state for the purpose of fixing the first rod sections 33*a*, 33*a* and the second rod sections 33*b*, 33*b* on the connectors 34, 34 and integrating the function lever 30. The operation lever still could be assembled on the receiving structures 20, 20 in the state that the fabrication error is absorbed, even though the handle 31, the first rod sections 33*a*, 33*a* and the second rod sections 33*b*, 33*b* were not arranged accurately and parallel to each other in the process of fabrication; when the operation lever 30 is operated by the user after being assembled, the single operation of the handle 31 would not be absorbed in the mid-way but could be transferred to air spring operating portions 36, 36 of the second rod sections 33*b*, 33*b* due to the rigidity of the connectors 34, 34 against the bending and twisting deformation, so that the operations of the push valves 16, 16 of two springs 13, 13 could be synchronized—i.e. they would contact with the push valves 16, 16 at the same time and push them in the same amount.

All operation rod units 32 extended into the receiving structures 20 are not of such structure utilizing the connector 34. It also may be of the structure with one operation rod unit 32 without the connector 34 extending to the receiving structure 20 (the third rod unit) directly and the rest operation rod units 32 utilizing the connectors 34. The operation rod unit 32 extending directly to the receiving structure 20 is used as the benchmark operation rod unit for other operation rod units 32 maintaining synchronous. After loosening the small screws 34*c*, 34*c* on all connectors, the operation lever 30 is operated and the third rod unit extending to the receiving structure 20 directly is made contact with the push valve 16 of the air spring 13. In this state, the insertion amount and angle of the first rod section 33*a* and the second rod section 33*b* to the connector 34 are adjusted in the operation rod unit 32 so as to make the air spring operating portion at the tip end of the second rod section 33*b* contact with the push valve 16 of the air spring 13 (only contact, without inward pushing). In such state, the small screws 34*c*, 34*c* in all connectors 34 are tightened to fix the first rod section 33*a* and the second rod section 33*b* on the connector 34 and the operation lever 30 is assembled in an integrated state. After assembling, the operation lever 30 is operated, then in all the operation rod units 32 including the third rod section, the amount of a single operation at the handle 31 would not be absorbed in the mid-way but could be transferred to all air spring operating portions 36, and synchronize the operations of the push valves 16 of all air springs 13.

FIG. 3-FIG. 6 are the perspective views of the embodiments 2-5 of the lifting table with height adjustment device according to this Invention. In those embodiments, the lifting tables are different only on aspects of the shapes of the top plates and the table leg structures supporting the top plates. There is no substantial difference between the support columns and the receiving structures. On aspect of the operation lever, although it is changed correspondingly according to the shapes of top plate as well as the setting differences of the support columns and receiving structures, but their fundamental structures are same. Therefore, although the top plates, table leg structures and operation levers are marked with the symbols "a"-"d" for identification in the embodiments, but the details of support columns, receiving structures and operation levers are of the same structure to those of the first embodiment fundamentally, and the same symbols to those of the first embodiment are used, the detailed explanation about them is not repeated. Besides, on aspect of the connectors, as in the case of the first embodiment, when all the air spring operation portions 36 contact with the push valves 16 of the air springs 13, all the rod sections 33 may be fixed on the corresponding connectors 34 so that the single operation of the handle 31 may be transferred to individual air spring operation portion 36 but would not be absorbed in the mid-way. Therefore, the explanation about such function is not repeated.

Figure 3:
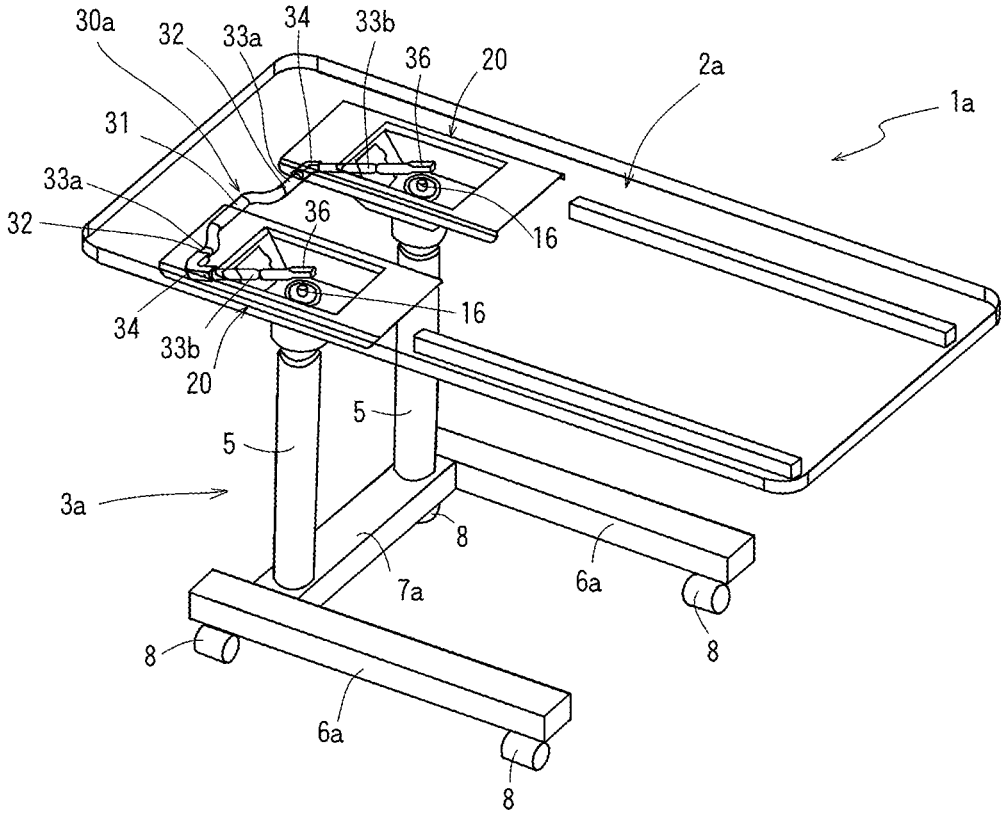
FIG. 3 is a perspective view of the second embodiment of a lifting table with height adjustment device according to the present invention.

In the second embodiment shown in FIG. 3, the elements and the positions with different structures and settings from those of the first embodiment are marked with the symbol "a". The lifting table 1*a* has a rectangle top plate 2*a* with long side on lateral direction, and the receiving structures 20, 20 are arranged in the area close to one side in the lateral length direction of said top plate 2*a* and are set apart along longitudinal direction. With respect to the Leg structure 3*a*, the central leg portion 7*a* is set on the side close to the side leg portions 6*a*, 6*a* according to the set positions of corresponding support columns 5, 5 of the receiving structures 20, 20. The function lever 30*a* has the mechanisms corresponding to the arrangement of the receiving structures 20, 20, which mechanisms include the handle 31, the connectors 34, 34 and the second rod sections 33*b*, 33*b* which are same to those of the first embodiment, in addition to the shorter first rod sections 33*a*, 33*a*. Namely, the handle 31 is set at the corresponding central location of the short longitudinal edge of the top plate 2*a*, the first rod section 33*a* extends along the short longitudinal edge of the top plate 2*a* and the second rod section 33*b* extends orthogonally to the short longitudinal edge through the connector 34. The surface of the top plate 2*a* is of rectangle with long side on lateral direction, which is the most common. However, the top plate receiving structures 20, 20 are close to one side in the lateral length direction of the top plate 2*a* and are set separately on longitudinal direction. Thus, the lifting table 1*a* applies to the situation that the article on the top plate 2*a* is tending to one side (toward the direction with top plate receiving structures 20, 20) or that the space below the top plate is to be used effectively.

Figure 4:
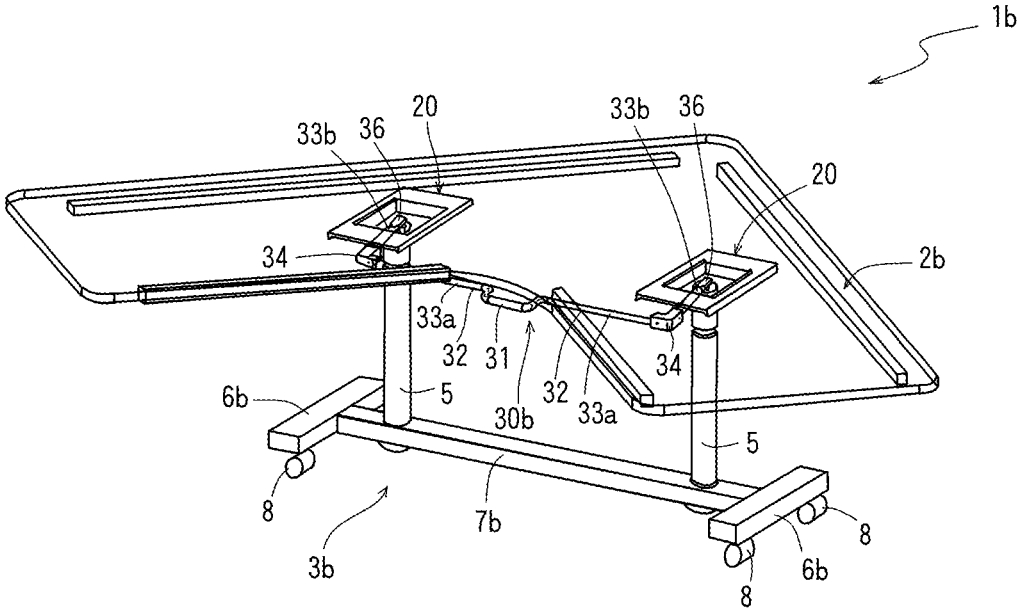
FIG. 4 is a perspective view of the third embodiment of a lifting table with height adjustment device according to the present invention.

In the third embodiment shown in FIG. 4, the elements and the positions with different structures and settings from those of the first embodiment are marked with the symbol "b". The lifting table 1*b* has a L-shaped top plate 2*b* with a curved inner edge on inner side, and the receiving structures 20, 20 are arranged relatively spaced apart on the left and the right sides of the top plate 2*b* with the curved inner edge interposed therebetween. Therefore, the receiving structures 20, 20 are tilting to the linear edges of the top plate 2*b*. The operation lever 30*b* is of a structure corresponding to the arrangement and placement of the receiving structures 20, 20, and includes the connectors 34, 34 and the second rod sections 36*b*, 36*b* (orthogonal to the first rod sections 33*a*, 33*a*) same to those of the first embodiment; but the handle 31 extends along the inner curved edge of said top plate 2*b*. The table leg structure 3*b* has a long central leg portion 7*b* subject to the set position of the support columns 5, 5 corresponding to the receiving structure 20, 20. This lifting table 1*b* is suitable for the user to seat on the chair along the inner curved edge and use the office table or working platform with the L-shaped top plate 2*b* being placed in the right-angle corner of a room.

Figure 5:
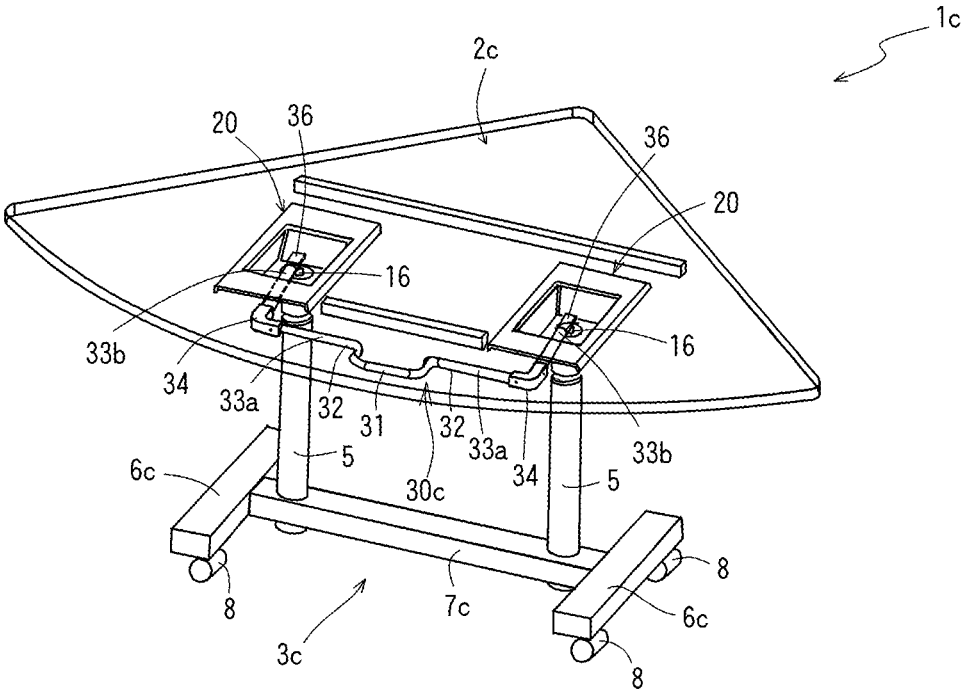
FIG. 5 is a perspective view of the fourth embodiment of a lifting table with height adjustment device according to the present invention.

In the fourth embodiment shown in FIG. 5, the elements and the positions with different structures and settings from those of the first embodiment are marked with the symbol "c". The lifting table 1*c* has a fan-shaped top plate 2*c*, and the receiving structures 20, 20 are arranged relatively spaced apart on left side and the right side along the chord direction of the fan-arc edge of the fan-shaped top plate 2*c*. Thus, the receiving structures 20, 20 are set tilting to the linear edge sections of the top plate 2*c*. The operation lever 30*c* is of a structure corresponding to the arrangement and placement of the receiving structures 20, 20, the handle section 31 is set along the fan-arc edge of the top plate 2*c* and includes the first rod sections 33*a*, 33*a*, connectors 34, 34 and the second rod sections 33*b*, 33*b* similar to the first embodiment. The first rod sections 33*a*, 33*a* extend along the direction parallel to the chord direction of the fan-arc edge, and the second rod sections 33*b*, 33*b* extend orthogonally to the first rod sections 33*a*, 33*a* through the L-shaped connectors 34, 34. The table leg structure 3*c* has side leg portions 6*c*, 6*c* and a central leg portion 7*c* as in the case of the first embodiment, subject to the set position of the support columns 5, 5 corresponding to the receiving structure 20, 20. This lifting table 1*b* is suitable for the user to seat on the chair along the fan-arc edge and use the office table or working platform with the L-shaped top plate 2*b* being placed in the right-angle corner of a room. Besides, four lifting tables 1*c* could be combined into one round table. The height of the top plate 2*c* could be adjusted according to the situation of the people seating around the round table.

Figure 6:
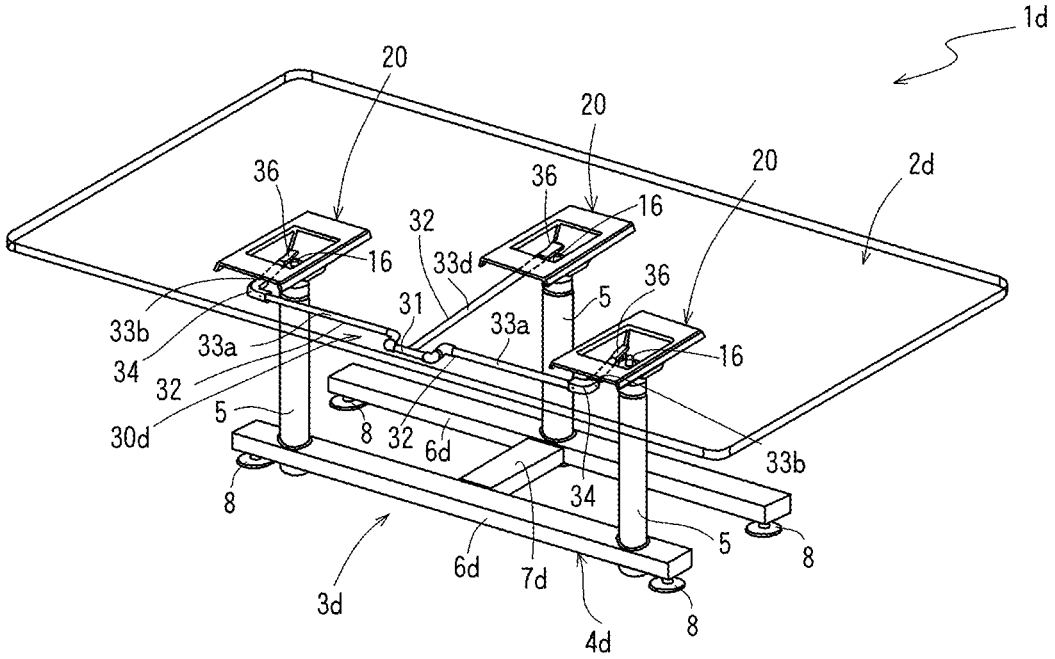
FIG. 6 is a perspective view of the fifth embodiment of a lifting table with height adjustment device according to the present invention.

In the fifth embodiment shown in FIG. 6, the elements and the positions with different structures and settings from those of the first embodiment are marked with the symbol "d". The lifting table 1*d* has a rectangle top plate 2*d* with long side on lateral direction and three top plate receiving structures 20. In those three top plate receiving structures, the left and the right receiving structure 20, 20 are close to the long lateral side of the top plate 2*d* and set separately, and the remaining one receiving structure 20 is set separately from the aforesaid two so as to form a isosceles triangle, those three receiving structures 20 support the top plate 2*d* in a wide range. With regard to the operation lever 30*d*, as the operation rod units 32, in addition to the first rod sections 33*a*, 33*a*, the connectors 34, 34 and the second rod sections 33*b*, 33*b* in symmetry, the third longitudinal rod section 33*d* extends from the handle 31, orthogonally to the long lateral edge and directly into the top plate receiving structure 20. Besides, with respect to the structure of the base leg body 4*d* of the table leg structure 3*d*, the side leg portions 6*d*, 6*d* are longer while the central leg portion 7*d* is shorter. According to the area of the top plate 2*d*, four supporting legs 8 are set separately and support the top plate 2*d* stably on the floor. Thus, the top plate 2*d* of the lifting table 1*d* has a wide area and could bear the heavy articles. It is very suitable for big tables.

Figure 7A:
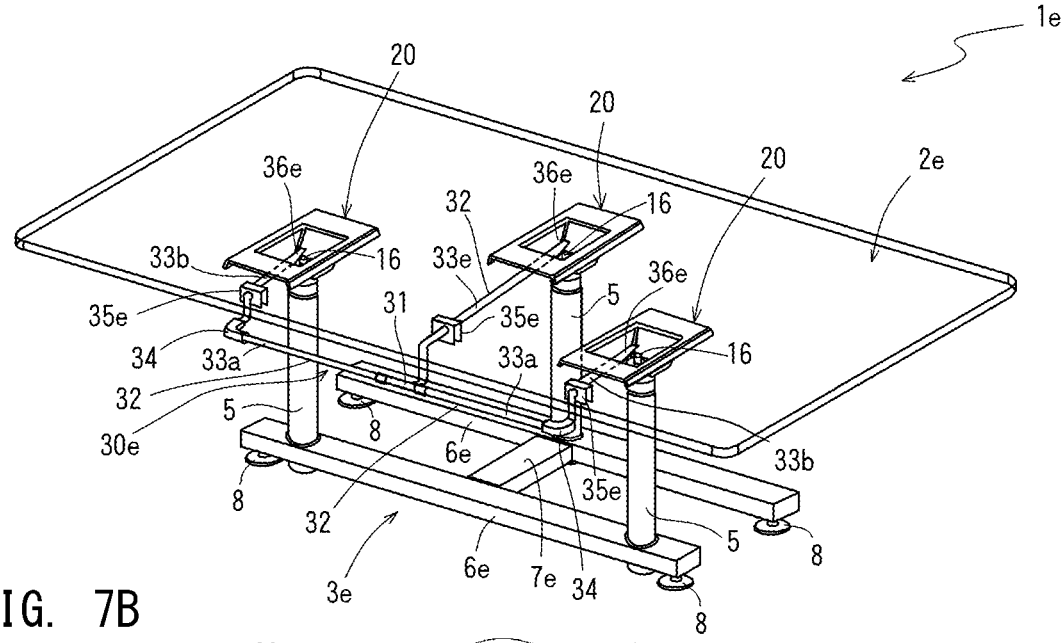
FIGS. 7A, 7B and 7C are perspective views of the sixth embodiment of a lifting table with height adjustment device according to the present invention.
Figure 7B:
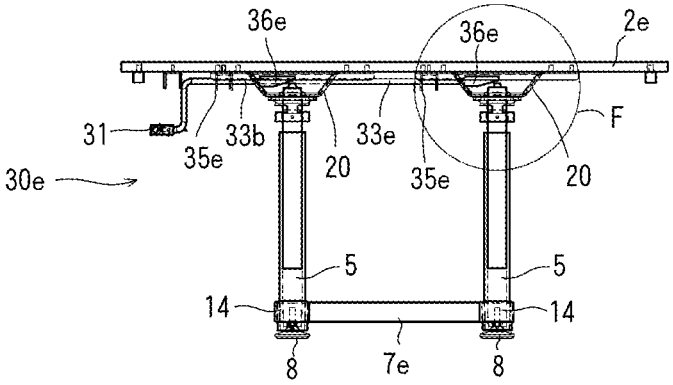
Figure 7C:
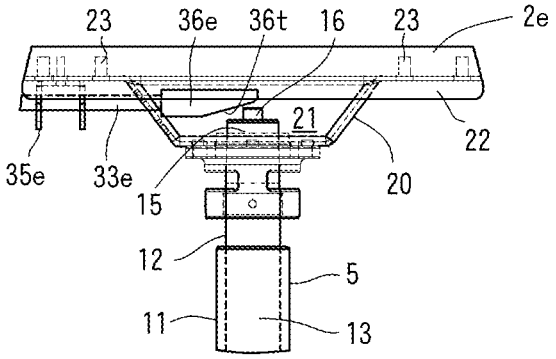

FIGS. 7A-7C are perspective views of the sixth embodiment of the lifting table with height adjustment device according to this Invention. FIG. 7A is the overall perspective view of the lifting table, FIG. 7B is the left side view of the lifting table and FIG. 7C is the enlarged view of the part indicated with F in the FIG. 7B. The biggest difference in this embodiment from the fifth embodiment shown in FIG. 6 is that the operation lever is not of swinging type but is of lateral sliding type. However, the shapes and the structures of the top plates and the table leg structures of the lifting table are not different substantially including those three support columns 5. Therefore, the top plates, table leg structures and the operation levers are marked with the symbol "e" for identification; the details of the support columns 5, receiving structures 20 and the operation levers are fundamentally same to those of the fifth embodiment, and are marked with same symbols, so that the detailed description will not be repeated.

With respect to the lifting table 1*e* of the sixth embodiment, the operation lever 30*e* is not of swinging type operated to swing in a manner of approaching the back surface of the top plate 2*e* but of sliding type operated to move along the back surface of the top plate 2*e* as shown in FIG. 7A and FIG. 7B. In other words, the operation lever 30*e* is composed of the first rod sections 33*a*, 33*a* extended from the left and the right of the handle 31, as two operation rod units 32, 32, and the L-shaped connectors 34, 34 which are connected to the tip ends of the handle 31. The second rod sections 33*b*, 33*b* are connected to the connectors 34, 34 along the direction orthogonal to the first rod sections 33*a*, 33*a* (the direction parallel to the top plate 2*e*). The second rod sections 33*b*, 33*b* bends upwards directly to approach the top plate 2*e*, bends again to get parallel to the top plate 2*e* and extends into corresponding receiving structures 20, 20 under the guidance of the guiding devices 35*e*, 35*e*. In addition to the first rod sections 33*a*, 33*a*, the operation lever 30*e* also includes the third rod section 33*e* which extends directly into the top plate receiving structure 20 provided in the center back of the top plate as the third operation rod 32. The third rod section 33*e* extends from the handle 31 and orthogonally to the long lateral edge and in the direction parallel to the top plate 2*e* before bending upwards directly to approach the top plate 2*e*; then, it bends again until being parallel to the top plate 2*e*, and extends into the corresponding receiving structure 20 in center back under the guidance of the third guiding device 35*e*.

The second rod sections 33*b*, 33*b* and the third rod section 33*e* have air spring operation portions 36*e* with tapered surfaces 36*t* formed at the tip ends respectively in the corresponding receiving structure 20. The handle 31 of the operation lever 30*e* is hold, and is pushed in the direction along the back surface of the top plate 2*e*, the second rod sections 33*b*, 33*b* and the third rod section 33*e* will be guided by the guiding device 35*e* respectively, the air spring operation portions 36*e* at the tip end will push the push valves 16 of the air springs 13 with its tapered surface 36*t*, and operate synchronously. The connectors 34, 34 operate with same function as those of the connectors in the fifth embodiment so that the detailed description will not be repeated.

Figure 8A:
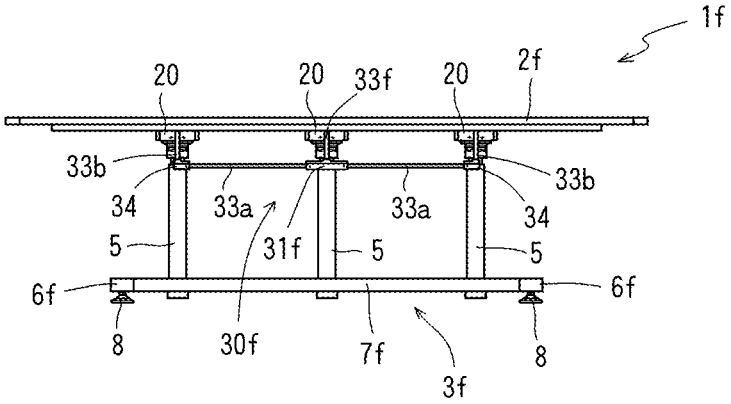
FIGS. 8A, 8B and 8C are perspective views of the seventh embodiment of a lifting table with height adjustment device according to the present invention.
Figure 8B:
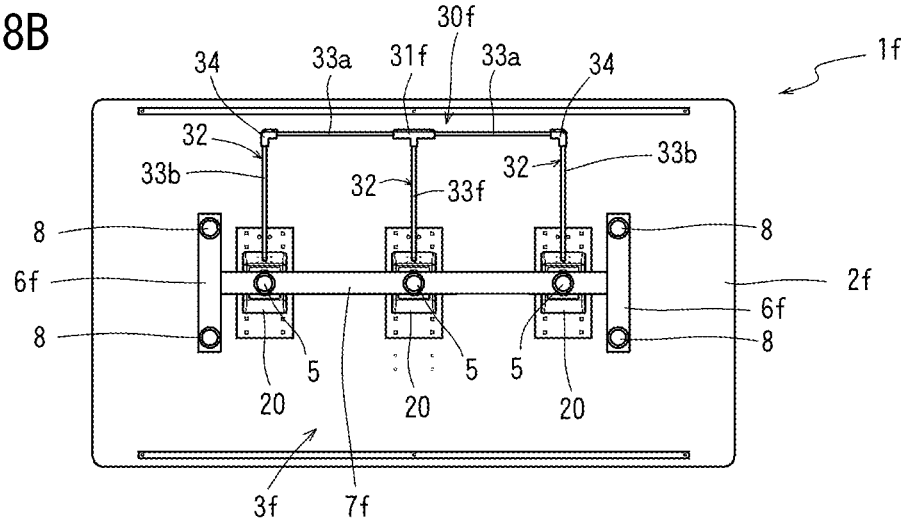
Figure 8C:
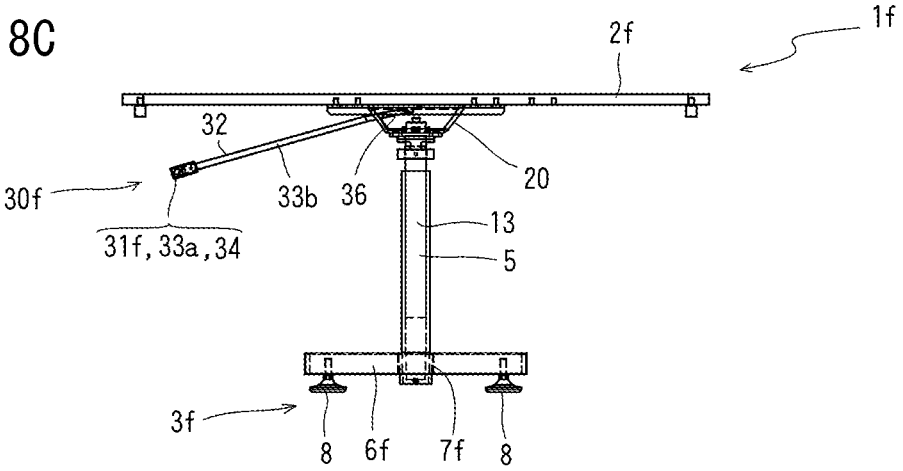

FIGS. 7A-7C are schematic views of the seventh embodiment of the lifting table with height adjustment device according to this Invention. FIG. 8A is the front view of the lifting table, FIG. 8B is the side view of the lifting table and FIG. 8C is the side view of the lifting table. The biggest difference in this embodiment from the fifth embodiment shown in FIG. 6 is that the three support columns 5 are arranged in a straight line along the long side direction in the center so that the load on big table could be supported evenly. However, the shapes and the structures of the top plates and the table leg structure of the lifting table are not different substantially including those three support columns 5. Therefore, the top plates, table leg structure and the operation levers are marked with the symbol "f" for identification; the details of the support columns 5, receiving structures 20 and the operation levers are fundamentally same to those of the fifth embodiment, and are marked with same symbols, so that the detailed description will not be repeated.

In the seventh embodiment, with regard to the three support columns 5 supporting the top plate 2*f*, the handle and the three operation rod units 32 are connected by the connectors interposed between their connecting portions. In other words, in the seventh embodiment, the handle 31*f* also serves as the T-shaped connector. With respect to the operation rod units 32, 32 extended from the handle (T-shaped connector) 31*f* in the left and the right direction, the handle 31*f* is connected to the first rod sections 33*a*, 33*a*, and the handle 31*f* is also connected to the third rod section 33*f* from the center in a manner orthogonal to the first rod sections 33*a*, 33*a*. The third rod section 33*f* is connected to the handle section 31*f* in the same way to the connector 34, which allows the rod section rotate around the axis and move along the axis direction. The first rod sections 33*a*, 33*a* also may be connected to the handle section 31*f* in the same way to the third rod section 33*f*. In the state that the air spring operation portions 36 provided at the tip ends of the second rod sections 33*b*, 33*b* and the third rod section 33*f* contact with the push valves 16 of all air springs 13, the small screws are screwed into the connectors 31*f*, 34, 34 so that the operation lever 30*f* will be integrated. Then, all the air spring operation portions 36 in the individual receiving structure 20 could push the push valves 16 to realize the synchronized movements of all air springs 13 by operating the handle 31*f*.

For the convenience of assembling and disassembling, the top plate 2 of table 1 and table leg structure 3 should be of assembly type and be fitted with fixing parts which could be disassembled. When assembly type lifting table is utilized, the lifting table with height adjustment device according to this Invention may be applied to the existing tables, television bench, writing desk or other articles with lifting function. Besides, the receiving structure 20 and the table leg structure 3 may be of embedded resin structure or be made of aluminum or iron etc. for the purpose of ensuring the function and improving the strength of the air spring support. They shall be fabricated with the materials selected according to the required strength and used flexibly according to the purposes etc. As a production example, in the case of mainly resin, there can be mentioned pp (polypropylene) to which glass fiber, nylon, aluminum and iron are added. In addition, the table legs (wood, iron or stainless steel products) may be inserted into the air spring receiving structures as general table legs. After the table legs are inserted into the air spring receiving structure made of resin, they also may be fixed with fastening screws.

| | | |
|---|---|---|
| 1. lifting table | 2. top plate | 3. table leg structure |
| 4. base leg body | 5. support column | 6. side leg |
| 7. central leg portion | 8. supporting foot | |
| 11. outer cylinder | 12. inner cylinder | 13. air spring |
| 14. lower end section of outer cylinder 11 | | |
| 15. upper end section of inner cylinder 12 (bearing section) | | |
| 16. push valve | | |
| 20. receiving structure | 21. recess | 22. peripheral section |
| 23. fixing part | | |
| 30. operation lever | 31. handle | 32. operation rod unit |
| 33. rod section | 33a. first rod section | 33b. second rod section |
| 34. connector | 34a. hole | 34b. screw hole |
| 34c. small screw | 35. lever fulcrum | 35e. guiding device |
| 36, 36e. air spring operation portion | | 36t. tapered surface |
| Ga, Gb. Gaps | X, Y directions | θ, δ angles |

The invention claimed is:

1. A lifting table provided with top plate height adjustment device, comprising:

a top plate, and a leg structure with multiple support columns mutually arranged in parallel for supporting said top plate relative to the floor, wherein said each support column has a length-changeable gas spring installed therein and is attached to said top plate via a top plate receiving structure;

said each gas spring has a push valve for changing a length of said support column, the push valve is exposed on an inside of said top plate receiving structure, said push valve is operated by an operation lever to change the length of said support column, thus adjusting a height of said top plate from the floor;

said operation lever comprises a single handle and operation rod units that extend respectively and individually to each said top plate receiving structure from said single handle;

said all operation rod units or all the remaining said operation rod units except for one operation rod unit include multiple rod sections which are connected by connectors respectively;

a gas spring operation portion is provided on a tip end of said each rod section extending to the inside of said top plate receiving structure, the gas spring operation portion operates said push valve;

said support columns for supporting said top plate consist of two support columns;

two said operation rod units of said operation lever include respectively, as said multiple rods, first rod sections that extend horizontally from said handle, and second rod sections that extend along a direction perpendicular to said first rod sections to the inside of said top plate receiving structures and have said gas spring operation portions on tip ends thereof;

said connectors are two L-shaped connectors, each connector connects said first rod section and said second rod section, so as to form two units each including said first rod section and said second rod section.

2. The lifting table provided with top plate height adjustment device according to claim 1, when all said second rod sections or all said second rod sections and a third rod section have lever fulcrums supported by said top plate receiving structures, each said gas spring operating portion pushes the push valve to work by swing motion of said rod section while being supported at said lever fulcrum.

3. The lifting table provided with top plate height adjustment device according to claim 1, wherein all said second rod sections or all said second rod sections and third rod sections are possible to move forward and backward in said top plate receiving structure and have tapered surfaces on tip ends engageable with said push valves as the gas spring operation portions, when said rod sections entering in said top plate receiving structures, said tapered surfaces being forced to engage with and to push said push valves to work.

4. The lifting table provided with top plate height adjustment device according to claim 1, wherein said top plate is a rectangle top plate that is longer in lateral direction, and two top plate receiving structures are set on the two sides apart in the lateral length direction of said top plate;

with respect to said operation lever, said handle is set in the central position of the lateral long side edge of said top plate, said first rod sections extend along the lateral long side edge of said top plate, and said second rod sections extend in a direction perpendicular to said lateral long side edge via said L-shaped connectors.

5. The lifting table provided with top plate height adjustment device according to claim 1, wherein said top plate is a rectangle top plate that is longer in lateral direction, and two top plate receiving structures are set close to one side in the lateral length direction of said top plate and are set apart in the longitudinal direction;

with respect to said operation lever, said handle is set in a central position of the longitudinal short side edge of said top plate, said first rod sections extend along the longitudinal short side edge of said top plate, and said second rod sections extend in a direction perpendicular to said longitudinal short side edge via said L-shaped connectors.

6. The lifting table provided with top plate height adjustment device according to claim 1, wherein said top plate is a L-shaped top plate with a curved inner edge, and two top plate receiving structures are set separately in a slant way with said curved inner edge of said top plate interposed between said receiving structures;

with respect to said operation lever, said handle is set along said curved inner edge of said top plate, said first rod sections extend along the tangential direction of said curved inner edge, and said second rod sections extend in a direction perpendicular to said lateral rod sections via said L-shaped connectors.

7. The lifting table provided with top plate height adjustment device according to claim 1, wherein said top plate is a fan-shaped top plate, two top plate receiving structures are set separately along a chord direction of an arc edge of said top plate;

with respect to said operation lever, said handle is set along said arc edge of said top plate, said first rod sections extend along the chord direction of said arc edge, and said second rod sections extend in a direction perpendicular to said lateral rod sections via said L-shaped connectors.

8. A lifting table provided with top plate height adjustment device, comprising:

a top plate, and a leg structure with multiple support columns mutually arranged in parallel for supporting said top plate relative to the floor, wherein said each support column has a length-changeable gas spring installed therein and is attached to said top plate via a top plate receiving structure;

said each gas spring has a push valve for changing a length of said support column, the push valve is exposed on an inside of said top plate receiving structure, said push valve is operated by an operation lever to change the length of said support column, thus adjusting a height of said top plate from the floor;

said operation lever comprises a single handle and operation rod units that extend respectively and individually to each said top plate receiving structure from said single handle;

said all operation rod units or all the remaining said operation rod units except for one operation rod unit include multiple rod sections which are connected by connectors respectively;

a gas spring operation portion is provided on a tip end of said each rod section extending to the inside of said top plate receiving structure, the gas spring operation portion operates said push valve;

the rod sections and connectors are configured such that when connecting said rod sections to said connectors, first all gas spring operation portions contact to said push valves when said rod sections are in a connection state by the connectors but not fixed yet, and second said rod sections are fixed to said connectors.

* * * * *